US007172066B2

(12) United States Patent
Peuker et al.

(10) Patent No.: US 7,172,066 B2
(45) Date of Patent: Feb. 6, 2007

(54) DEVICE FOR STORING AND MIXING PASTY MATERIALS

(75) Inventors: Marc Peuker, Seefeld (DE); Ralf Kuerschner, Gauting (DE); Birgit Koenig, Munich (DE); Mathias Bertl, Wildsteig (DE); Markus Roepke, Poecking (DE)

(73) Assignee: 3M ESPE AG, Seefeld (DE)

( * ) Notice: Subject to any disclaimer, the term of this patent is extended or adjusted under 35 U.S.C. 154(b) by 355 days.

(21) Appl. No.: 10/275,819

(22) PCT Filed: May 4, 2001

(86) PCT No.: PCT/EP01/05068

§ 371 (c)(1),
(2), (4) Date: Jul. 24, 2003

(87) PCT Pub. No.: WO01/85569

PCT Pub. Date: Nov. 15, 2001

(65) Prior Publication Data

US 2004/0029077 A1 Feb. 12, 2004

(30) Foreign Application Priority Data

May 10, 2000 (DE) ..... 100 22 564
Sep. 25, 2000 (DE) ..... 100 47 679

(51) Int. Cl.
*B65D 25/08* (2006.01)

(52) U.S. Cl. ..... 206/219; 206/568

(58) Field of Classification Search ..... 206/219–222, 206/568, 581, 499
See application file for complete search history.

(56) References Cited

U.S. PATENT DOCUMENTS

| | | | | | |
|---|---|---|---|---|---|
| 2,971,851 | A | * | 2/1961 | Kurtz | 206/219 |
| 3,083,821 | A | * | 4/1963 | Woodson | 206/568 |
| 3,618,751 | A | * | 11/1971 | Rich | 206/219 |
| 3,722,833 | A | | 3/1973 | Inoue et al. | |
| 4,201,031 | A | | 5/1980 | Wiles | |
| 4,256,256 | A | | 3/1981 | Meyers | |
| 4,341,302 | A | * | 7/1982 | Baker et al. | 206/219 |
| 5,143,210 | A | * | 9/1992 | Warwick et al. | 206/499 |
| 5,373,966 | A | | 12/1994 | O'Reilly et al. | |
| 5,542,539 | A | * | 8/1996 | Early | 206/499 |
| 5,660,273 | A | | 8/1997 | Discko, Jr. | |
| 5,928,213 | A | | 7/1999 | Barney et al. | |
| 5,947,920 | A | * | 9/1999 | Beck | 206/219 |
| 6,003,673 | A | | 12/1999 | Vieu | |

FOREIGN PATENT DOCUMENTS

| | | |
|---|---|---|
| DE | 9000839 U1 | 5/1990 |
| EP | 0115562 A1 | 8/1984 |
| EP | 0916583 A2 | 5/1998 |
| EP | 0603704 B1 | 6/1998 |
| EP | 0895943 | 7/1999 |
| EP | 0619998 B1 | 8/2002 |
| WO | 99/59874 | 11/1999 |

* cited by examiner

*Primary Examiner*—Bryon P. Gehman
(74) *Attorney, Agent, or Firm*—Crowell & Moring LLP

(57) ABSTRACT

The invention relates to a device for storing and mixing especially pasty materials, preferably dental materials, such as filler materials. The invention comprises at least one compartment (7) that receives the substance, said at least one compartment (7) being formed by sealing (3) a base film (1) and a cover film (2), which can be detached from each other by peeling.

16 Claims, 2 Drawing Sheets

DEVICE FOR STORING AND MIXING PASTY MATERIALS

FIELD OF THE INVENTION

The invention relates to a device for storing and mixing substances, in particular dental materials, preferably filler materials, such as composites, glass ionomer cements and compomers.

BACKGROUND AND SUMMARY OF THE INVENTION

Various storage devices for dental products are known from the prior art. Filler materials are often packed in small cartridges. However, there are also filler materials which, before their use, have to be prepared by mixing two pasty substances. These substances are usually applied from tubes or screw tubes and are mixed on a mixing block. This requires uniform dosing and a large number of maneuvers.

DE 90 00 839 U discloses a package for multi-component adhesive in small quantities, the components of the adhesive being arranged in bowl-shaped chambers between two interconnected films. By tipping one of the bowls over, its content can be transferred into the other bowl.

EP 0 916 593 A2 describes a flexible package for separate storage and simultaneous dispensing of two materials of a polymerizable system, in particular of an addition-crosslinking dental impression material, into beaker-shaped depressions.

EP 0 115 562 A1 describes a portioning package for storing and mixing silver and mercury, comprising two portioning packages which are made integral by a pair of films welded to one another to form two separate portioning pockets.

A multi-component chamber bag for storing liquid substances is described in DE 199 27572 A1, for example.

None of said devices permits both the storage of substances and also substantially loss-free mixing of these substances into a pasty material using the storage device.

Consequently, it is an object of the present invention to provide a device making it possible to store and mix substances, especially pasty substances.

This object is achieved by a device and by a method for producing the device, as described below.

The terms "comprise" and "contain" within the meaning of the invention introduce a nonexhaustive list of features. Likewise, the word "one" is to be understood in the sense of "at least one".

The invention has the following advantages:

In the device according to the invention, the substances to be mixed can be packaged optimally in the required quantity. Incorrect dosing and incorrect mixing ratios are largely ruled out.

After the cover film and bottom film have been pulled off, the substances to be mixed are present in the state ready for mixing and do not first have to be pressed out of different vessels or transferred to a container for mixing. The storage area is part of the mixing area. In this way, 100% of the pre-dosed quantities which are to be mixed are available for mixing. The mixed paste can thus be used substantially without residues.

The base film serves at the same time as a mixing surface after the cover film has been pulled off and its material properties can be adapted to the reactivity of the substances which are to be mixed.

The term "chamber" is to be understood as a hollow space which is closed off from the outside and which is formed by connection of at least two films (base film or bottom film and cover film or top film), for example by adhesive bonding, sealing, heat-sealing or high-frequency sealing, and can be peeled completely open by pulling the films off or apart in the sealing area.

The chambers can be arranged in any desired way, but preferably in such a way that mixing is readily possible after activation of the device. The chambers are arranged substantially centrally, if appropriate along one axis on the nonactivated device.

The volume of the at least two chambers can be enlarged if appropriate by slight thermoforming, in particular of the cover films, in this area. The chamber volume to be chosen is dependent on the intended use and in principle unlimited. Suitable chamber volumes are usually in the range of 0.01 through 10 ml.

The term "not substantially thermoformed" or "only slightly thermoformed" within the meaning of the invention means that the ratio of diameter to depth of the chamber is greater than or equal to 5:1, preferably greater than or equal to or flatter than 10:1.

The chambers can have any desired shape, but they are preferably round or oval. In the case of two-component and multi-component materials, oval chambers arranged one behind the other may be practical for reasons of space, in which case the small ellipse radii are preferably arranged substantially along the longitudinal axis of the device.

Droplet-shaped chambers are also expedient, in which case the "droplet tip" points to the optionally provided ribbing of the film or to an optionally provided tab.

In this way, the device is easier to open because the force to be applied initially to pull off or peel off the film in the area of the droplet-shaped tip of the sealed seam is slight and increases only gradually to the force needed to pull off the film in the area of the full width of the sealed seam.

This effect can also be achieved if the sealing area surrounding the chambers has a shape with at least one area which narrows in one direction and which points in the direction of an optionally provided pull-off tab.

In order to ensure that the chambers are fully opened in a manner which is substantially uniform and free from residues in order to form a plane mixing area, it has proven expedient for the chamber, or the sealing area surrounding it, to be designed gradually tapering to a point also on the side of the chambers remote from the tab.

If the device has a plurality of chambers, it has proven expedient if the sealing areas forming the chamber are connected to one another, in order to ensure uniform opening of the chambers upon activation of the device. An hourglass-shaped connection area is preferred.

Such a design of the sealing edge connection between two chambers largely ensures that the substances to be stored and to be mixed are not spilled upon activation of the device.

When the chambers are arranged transversely with respect to the longitudinal axis of the device, it has proven expedient if each chamber or its sealing area has a droplet tip pointing in the direction of an optionally provided ribbing. The droplet tips of the sealed seams can in this case also open into a common tip.

"Activation" within the meaning of the invention is to be understood as opening the device by pulling the cover film or top film off or up from the base film or bottom film, exposing a substantially plane mixing area on which the substance or substances to be mixed are located.

If appropriate, the device has a pocket in which an applicator suitable for mixing and application is situated.

The term "pocket" is to be understood here as a container open at least on one side. The shaping of the pocket can be effected by one sealed seam, individual sealed webs and/or sealed points.

To prevent contamination of the mixing area during storage (mixing area=area needed for mixing the material portions), it may be expedient to run a narrow peelable seam around this area. This seal is completely opened upon activation of the device and if appropriate likewise has a sealed seam tip pointing to the pull-off tabs or ribbings in order to make it easier to detach the films sealed to one another.

The applicator preferably has the shape of a spatula and can be made of wood, metal or a suitable plastic. If appropriate, the applicator has an angled shape or, depending on the width, a nonrectangular or round, beveled end. An angle in the range of 5 to 45° relative to the longitudinal axis is preferred.

The use of an angled applicator permits mixing on the device according to the invention and handling in the manner to which, for example, a dentist's assistant is accustomed when using a mixing block. In contrast to the device according to the invention, a mixing block has a certain height relative to, for example, a table surface acting as its support and it thus also permits mixing using a straight spatula.

It can also be advantageous if base film and cover film are componnet parts of a single film, which can also be a multi-layer film. In this embodiment, the flat mixing surface is formed by pulling apart the base film or bottom film and the cover film or top film, without the cover film or top film being completely pulled off or removed.

The term "flat mixing area" within the meaning of the invention is to be understood as an area which, during mixing with an applicator, does not throw up any folds and has substantially no depressions or only very slight depressions which are negligible in terms of the intended use.

Surprisingly, it has been found that in certain aluminum composite films, depending on the film structure, a thermoforming ratio of between 5:1 and 10:1 is possible, and in which, during the mixing process on the mixing area with the aid of a suitable applicator, the thermoformed areas can be restored again by upsetting to a fold-free film.

However, the fact that a substantially flat mixing area is formed upon activation of the device does not rule out the possibility of mixing the substances on a conventional mixing block after they have been scraped off onto the latter.

Depending on the application, the mixing area has a surface in the range of 5 to 300 $cm^2$.

The device preferably has holding arrangements in the edge area, which holding arrangements are intended to make it easier to handle the device during mixing.

Such holding arrangements can be in the form of ribbings in the edge area of the device and can be introduced into the film, for example by embossing.

However, it is also possible to provide two ring-shaped tabs or to punch holes or slits, in particular two slits in the longitudinal direction, in the edge area of the device, which make it easy to hold the activated device. This permits mixing of the substances on the mixing area even without a solid support.

It can also be advantageous to apply adhesive areas as a profiled coating or as two-sided adhesive points or adhesive strips which make it easier to fix the activated device to a surface. These adhesive areas can, if appropriate, be on a turned-back film of the device or can be covered with additional cover film to prevent premature adhesion.

Depending on the area of use, it may be sufficient if the device has individual adhesive areas only in the edge areas. It is also conceivable, however, that the films of the device are made almost completely adhesive on the side directed away from the substance. In this embodiment, the device, for mixing purposes, could be positioned almost stationary on a surface.

Alternatively, the device can also be arranged on a block with an adhesive surface. Each side of the block can be used for several mixing applications until, after contamination or wear, a fresh adhesive sheet is used. The individual sheets or component parts of the block are in this case preferably not coated completely with an adhesive, but instead have an area which is free of adhesive and allows the individual sheets or component parts to be pulled off.

It can also be useful to use an adhesive block which has a partial adhesive coating in a surface area set in by 1 to 5 mm (i.e. smaller) than the activated device to be fixed thereon. This makes it easier, for example, to position the device on the adhesive block in the desired manner.

The arrangement of only one adhesive area in the edge area of the device and the alternate adhesion of several devices permits an advantageous packaging in the form of a dispenser. After one device has been removed from the dispenser, a new device is made ready for removal from an opening in said dispenser.

Adhesives which are particularly suitable are, inter alia, encapsulated adhesives (nanoparticles) which exert their adhesive property only when pressed onto a surface, for example. The adhesives are preferably of such a nature that they can again be removed from a surface without leaving any residue, for example from a table or mixing block serving as mixing support. A mixing plate with clamping ridges at both ends can also be used to clamp the pull-off tabs during the mixing process.

The device has at least one chamber, but can also have two, three, four or more chambers if appropriate, into which substances to be mixed can be introduced.

The provision of one chamber may be sufficient, for example, if the stored material tends to segregate during storage and has to be mixed again before use.

The device can preferably be produced in a simple and cost-effective way by "folding over" or "folding together" a single film and sealing it at least in the edge area of the chambers which are to be formed and into which the substance to be stored is introduced before sealing.

Planar side-sealed bags are conventionally sealed only on three sides, then filled via the unsealed opening, and this remaining opening is finally sealed. During the filling process, the as yet unsealed area is often contaminated with the filler material. This area has to be cleaned in order to guarantee the tightness of the fourth sealed seam.

According to the invention, it has been found that planar devices for storing and/or mixing of substances can also be produced and filled in a simpler manner.

The method for producing the device according to the invention comprises the following steps:

a) providing a base film or bottom film, b) if appropriate, partial thermoforming of the film so that the ratio of diameter to depth of the thermoformed area is greater than or equal to 5:1, preferably greater than or equal to 10:1, c) applying at least one substance onto the film which, depending on the film material used for the cover film or top film and on its deformation by thermoforming, has a sufficiently high stability to ensure that it cannot escape laterally during the sealing operation, d) sealing a cover film or top film on, preferably directly after step c), without the base film or bottom film from step a) having been thermoformed, and the base film or bottom film and the cover film or top film can be constituents of one film.

The sealed seam generated in step d) is closed upon itself. It is, for example, round, oval, rectangular, diamond-shaped or droplet-shaped.

Another method for producing the device comprises the following steps:

a) providing a base film or bottom film, b) turning the film back preferably to form a fold area, c) forming at least one sealed seam which intersects the fold area, at least two pocket-shaped arrangements being formed, d) introducing at least two substances separately into the corners of the pocket-shaped arrangements, e) sealing the pocket-shaped arrangements.

If appropriate, before step d), the pocket-shaped arrangements in the fold area can be widened by applying pressure parallel to the main direction of the sealed seam. This facilitates introduction of the substances and prevents the as yet unsealed areas from being contaminated with substances to be introduced.

To produce a device which is suitable for storing three components to be mixed, the following method has proven expedient:

a) providing a base film or bottom film, b) applying a first substance on a site of the subsequent fold area, c) turning the film back preferably to form a fold area, d) forming two intersecting sealed seams which also intersect the fold area, with one chamber and two pocket-shaped arrangements being formed, e) introducing at least two substances separately into the corners of the pocket-shaped arrangements, f) sealing the pocket-shaped arrangements.

In all of the methods, the sealed seams can have any desired shape.

If the substance to be stored is flowable, it should preferably have a viscosity in the range of $0.5\times10^{-3}$ to $10\times10^{3}$ Pas.

Upon production and filling of the device, the speed at which the chambers are sealed must be adapted to the viscosity or stability of the substances which are to be sealed-in.

A sufficiently high speed also makes it possible to seal relatively fluid substances between a substantially flat top film and bottom film, since, depending on its surface tension and its viscosity, the substance, after it has been applied to the bottom film, requires a certain time to disperse thereon or requires a certain time to spread into the area formed by the sealing of the top film or cover film on the bottom film, and to flow into the actual sealing area. This area should therefore be sealed promptly.

In one of these embodiments, a film is first made ready onto which a certain quantity of substance or substances to be mixed is applied, the film is folded preferably centrally and is sealed together in a peelable manner to leave at least one chamber in which the substance or substances are located, and the at least one chamber can also be located in the fold area.

The chambers are formed by sealing or adhesively bonding at least one or two films at least in the edge area of the chamber to be formed, leaving free a hollow space in which the substance to be mixed is located.

Depending on the embodiment, one or more of the sealing areas which form the chamber can also be replaced by a crease or fold which arises when the film is bent. In this case, the sealed seam is not closed on itself, but instead forms with the fold at least one closed chamber.

The sealing can be done in a manner familiar to the person skilled in the art, for example by heat-sealing or by ultrasonic sealing.

It can also be advantageous if the film areas which are pulled apart for opening the device do not correspond to the fold areas with which the device can be fixed, in particular clamped, after activation.

For this purpose, a film is preferably chosen which when folded forms no or only very slight kinks or the film in the fold area is turned back in such a way that when the cover film is pulled off or the cover film and base-film are pulled apart, no depressions are left in the fold area which could impair the mixing result. It is also conceivable not to fold the film via a sharp edge, but only to turn it back loosely so that a bead-shaped configuration remains in the fold area.

Films which are particularly suitable are those films, including multiple-layer films, which, when pulled off, do not permanently deform and/or warp, and in particular do not show a tendency to roll up, so that the formation of a substantially plane mixing surface is guaranteed.

If the film used has a tendency to roll up, it can be advantageous for the latter to be laid, during production, offset by 90° relative to the longitudinal axis of the device in order, after activation of the device, to prevent or reduce the rolling inclination of the film causing a restoring effect about the fold area of the film upon production of the device.

Peelable films are normally used which, when pulled off, can be separated from one another at the seal areas.

Foil materials which have proven advantageous are, for example, PE, PP, PA, PET, PVDC, PVC, EVA, EVOH, COC and paper/plastic composite films or a PE/paper composite. A combination with a paper/aluminum/paper/PE film sequence is preferred.

The films preferably have barrier layers in the form of vapor-deposited metal, such as aluminum, or ceramic, such as SiOx or AlOx.

For storing substances which are particularly sensitive to light, the use of aluminum composite films or opaque printed films has proven expedient. However, colored transparent films are also suitable.

The device according to the invention and the method according to the invention are suitable for storing and mixing any substances, said substances usually being present in a pasty consistency after they have been mixed.

In the case of substances which tend to polymerize under exclusion of oxygen, it is recommended to use single-layer films or laminated films without an oxygen-tight barrier layer such as aluminum. For storing what are called resin-modified glass ionomer cements, however, these films should form the most efficient possible water vapor barrier. Single-layer films such as sealable PE or PP films in an appropriate thickness of between 80 and 1000 μm or plastic laminate films with additional plastic barrier layers such as PET, EVOH, EVA, PA, COC, PVC, PVDC or thin aluminum or ceramic deposits ($Al_2O_3$, $SiO_x$) are conceivable. Thick single-layer films of greater than 200 μm can also be injection-molded and, in the case of a one-piece embodiment, can be made thinner at the kink point.

The substances which can be stored in the device and can be mixed with the aid of the device can be present as powder, granulate, in tablet form, as paste or as liquids.

The substances are, in particular, constituents of dental filler materials, such as composites, compomers, glass ionomer cements, or veneering materials, fixing cements, or crown and bridge materials. However, depending on the embodiment, impression compounds based on polyether or silicone can also be stored with the aid of the device.

The device is also suitable, however, for storing and mixing multi-component adhesives such as epoxide resin adhesives, or multi-component coloring agents. A hue mixed individually from two different colors can also be prepared by at least partial mixing of two color portions.

In order to guarantee sufficient storage stability and straightforward mixing, the substances and the outer layer of the base film should be adapted to one another so that the substances remain on the base film when the cover film is pulled off and they are not at least partially pulled off along with the cover film.

This can be achieved by using suitable coating materials, either by anti-adhesion coating of the cover film, for example with silicone oil or silicone varnish or erucamide varnish or PTFE in this area, if appropriate as a profiled coating and/or application of an adhesion promoter or application or incorporation of a micro-retentive surface on the base film. It is also conceivable for the substances which are to be stored to be coated with a suitable coating agent. Further suitable separating agents can be separating wax or sealing wax, which has an anti-adhesion effect in the unsealed area.

Similar effects can be achieved by applying a nano coating, as is described for example in VDI Nachrichten 1/01, page 9.

To avoid capillary effects, which can lead to the substances stored in the device "creeping" into sealed areas, it can be advantageous if the sealing area forming the chamber(s) is interrupted by a narrow unsealed area. In this area, the base film is preferably separated from the cover film by a groove-like hollow surrounding the chamber, which hollow is formed as a thermoformed profile in the cover film.

Depending on the field of application, however, it may also be expedient if, after activation of the device, the substance adheres both to the base film and also to the cover film. When the device is activated by means of the cover film or top film being pulled apart or off the base film or bottom film, then, depending on how the substance to be mixed is arranged on the base film, it is in this way divided, on the exposed mixing area, into two separate mixable portions.

This embodiment has proven particularly useful when using filler materials in dentistry, if the quantity of substance stored in the device is sufficient for more than one cavity.

Since, in this field, the substance normally begins to polymerize only after the mixing or begins to set, for example by a cement reaction, this embodiment makes it possible for only one portion of the stored quantity of substance to be mixed and processed initially, while the second portion remains unmixed on the mixing area.

By applying an anti-adhesion coating to either the cover film or base film, it is possible to ensure that, after activation of the device, the substances to be mixed remain adhering to only one of the films. In this way, it is possible to ensure that, in a device with two chambers, only two paste fields are formed after activation, and the mixing distance can be kept short.

After activation, i.e. after the cover film or top film has been pulled up or off, the device ready for mixing preferably has an elongate shape, for example the shape of an ellipse or a rectangle.

Different embodiments of the device according to the invention are described below.

DETAILED DESCRIPTION OF THE DRAWINGS

Figure 1:
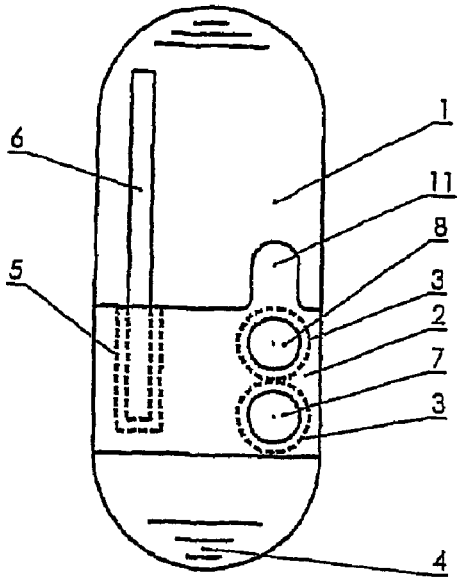
FIG. 1 shows an embodiment of the device according to the invention in a plan view, before activation.

FIG. 1 shows an embodiment of the device according to the invention in a plan view with a base film (1) and a cover film (2), the device having a pocket (5) for receiving an applicator (6). The ribbing (4) in the edge area of the device is also indicated. The broken lines (3) are the areas in which base film (1) and cover film (2) must be sealed together in a peelable manner so that the corresponding number of chambers (7, 8) can be formed. The cover film has a tab (11) making it easier to pull off. In a particular embodiment, the cover film is connected to the base film in such a way that it can be pulled off incompletely upon activation of the device. This can be achieved, for example, by a wide sealed seam at the end of the cover film.

Figure 2:
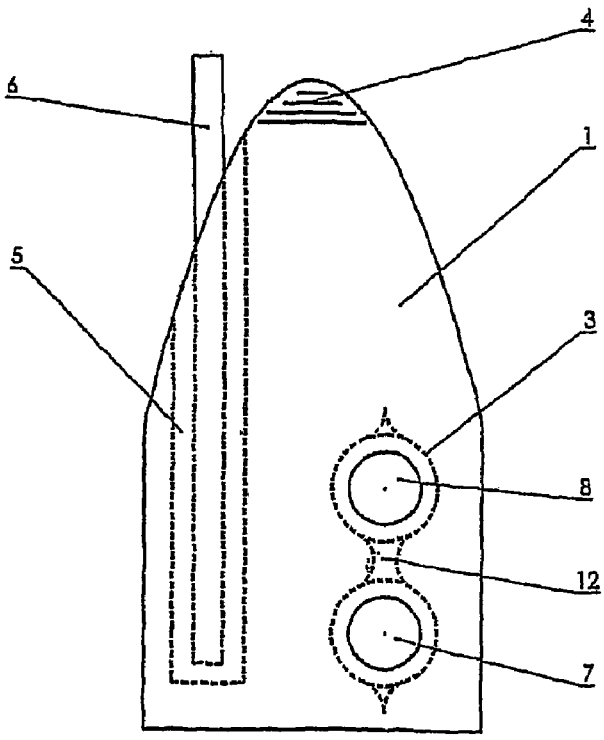
FIG. 2 shows a further embodiment of the device in a plan view.

FIG. 2 shows a further embodiment of the device in a plan view, where the base film is folded centrally so that cover film and base film (1, 2) form a common film. The device also comprises an applicator (6) which is located in a pocket (5). The figure also indicates the preferred droplet-shaped design of the seal area (3) surrounding the at least one chamber. One droplet tip points in the direction of the ribbing (4), in the surrounding area of which a pull-off tab can also be located, and the other points in the direction of the fold area. The seal areas (3) which form the two chambers are connected to one another via an hourglass-shaped seal area (12).

Figure 3:
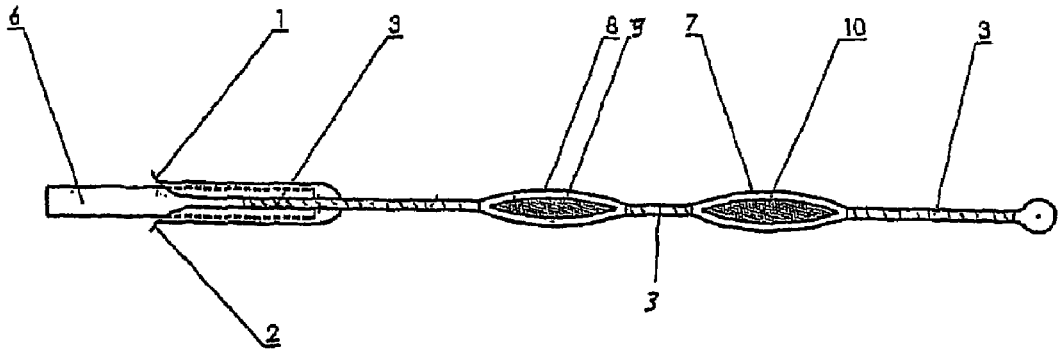
FIG. 3 shows the embodiment from FIG. 2 in cross section.

FIG. 3 shows the embodiment from FIG. 2 in cross section. The broken-line areas (3) are sealed such that they can be detached by peeling. The substances (9, 10) to be mixed are located in the chambers (7, 8). The film is not folded via a sharp edge, but instead is only loosely turned back and forms a bead (14) in the fold area.

Figure 4:
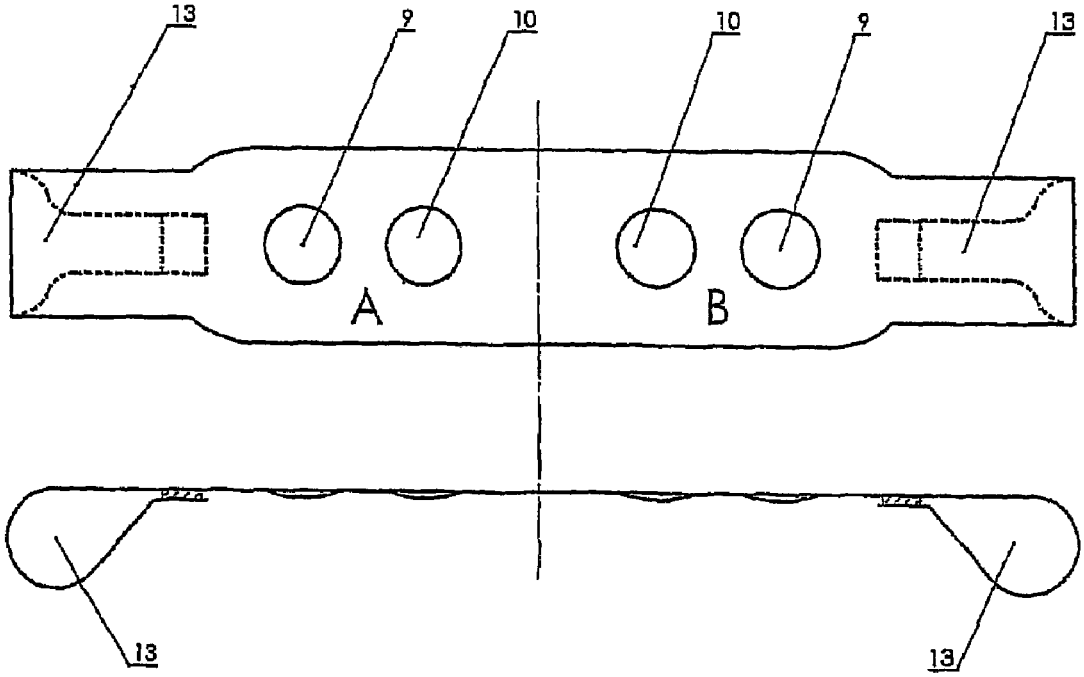
FIG. 4 shows an embodiment of the device after activation, in a plan view and in cross section.

FIG. 4 shows the device according to FIG. 2 after the activation operation, with a planar exposed mixing area on which two portions (A, B) of the substances (9, 10) to be mixed are located, which portions were originally sealed in two chambers. The figure also shows a preferred tab-shaped holding arrangement (13) in the edge area of the device, which together with the ribbing, or instead of the ribbing, permits the device to be held taut in order to achieve a substantially flat mixing area.

To permit simple activation or opening of the device, other embodiments are also conceivable. The device according to FIG. 2 can also be designed such that the two films are not arranged one above the other in the area of the ribbing, but are instead laterally offset. This can be achieved, for example, by a substantially point-symmetrical punch.

A similar arrangement can be obtained if the mirror-symmetrical film is not folded congruently but instead laterally offset. It is also possible to fold the device eccentrically so that one of the two film areas in the unopened state only partially overlaps the other film area.

The device is suitable, for example in dentistry, for storing and mixing dental filler materials in a quantity sufficient to supply one or two tooth cavities.

The invention claimed is:

1. A device for storing and mixing at least two substances, comprising:

at least two chambers for receiving substances to be mixed, wherein said chambers each have a peripheral area;

said chambers being formed by sealing a cover film to a base film at least in said peripheral areas of said chambers such that said cover film and said base film can be detached by peeling; and said cover film and said base film being constructed such that after at least partially detaching the cover film and the base film, the cover film and the base film together form a substantially flat planar area further including a portion of at least one of the cover film and the base film that formed at least part of the chambers.

2. A device according to claim 1, further comprising a pocket for receiving an applicator.

3. A device according to claim 1, further comprising means for holding the device during mixing.

4. A device according to claim 1, wherein each peripheral area of each chamber has a non-circular shape and a tapering portion, said tapering portion narrowing in one direction.

5. A device according to claim 4, further comprising a pull-off tab formed in said tapering portion.

6. A device according to claim 1, wherein said cover film and said base film are permeable to oxygen.

7. A device according to claim 1, wherein said cover film and said base film are impermeable to water vapor.

8. A device according to claim 1, further comprising at least two substances to be mixed wherein said substances are selected from the group consisting of dental filler material, fixing cement, crown material, bridge material, coloring agent, and adhesive.

9. A device according to claim 1, further comprising a mixing plate having an adhesive surface.

10. The device of claim 1 wherein said substantially flat mixing area includes both the cover film and the base film that formed at least part of the chambers.

11. The device of claim 1 wherein at least one of said cover film and said base film is provided with an adhesive surface.

12. A method for producing the device of claim 1, comprising the steps of:

(a) providing a base film which does not permanently deform or warp when pulled off a substrate;

(b) applying at least one pre-dosed quantity of a substance onto said base film, wherein said base film is not substantially deep-drawn between said steps (a) and (b); and (c) immediately sealing a cover film to at least an edge area of said base film to form a closed sealing seam, wherein said base film and said cover film comprise separate parts of a single film; the material of said cover film and the closing speed of sealing tools used in said step (c) are selected in view of the viscosity or inertia of said substance; no part of said substance escapes from said chamber during sealing; and said substance has a viscosity in the range from $0.5\times10^{-3}$ to $10\times10^{3}$ Pas.

13. A method according to claim 12, wherein said step (a) further comprises producing said base film by injection-molding.

14. A method for producing the device of claim 1 including at least two chambers and storing at least two substances, comprising the steps of:

(a) providing a base film which does not permanently deform or warp when pulled off a substrate;

(b) turning said base film back to form a folded portion;

(c) forming at least one peelable sealing seam which intersects said folded portion to define at least two pockets;

(d) separately placing said substances into corners of said pockets; and (e) sealing said pockets at least in a peripheral region of said pockets to form chambers, wherein upon activation of the device said chambers can be opened by peeling to form a substantially flat mixing area.

15. A method for producing the device of claim 1 including least two chambers and storing least two substances, comprising the steps of:

(a) providing a base film which does not permanently deform or warp when pulled off a substrate, (b) applying a first substance on said base film, (c) turning said base film back to form a folded portion at the location of said first substance (d) forming two mutually intersecting sealing seams which also intersect said folded portion, thereby forming a chamber and least two pockets, (e) separately placing said substances into corners of said pockets, and (f) sealing said pockets at least in a peripheral region of said pockets to form chambers, wherein upon activation of the device said chambers can be opened by peeling to form a substantially flat mixing area.

16. A method for mixing two substances, comprising the steps of:

(a) providing a device including at least two chambers storing the substances, each chamber having a peripheral area and being formed by sealing a cover film to a base film at least in said peripheral area of each chamber such that said cover film and said base film can be detached by peeling;

(b) peeling off at least one of said cover film and said base film to fully open each chamber so that the cover film and base film together form a substantially flat planar area and expose a substantially flat mixing area of said substantially flat planar area, said substantially flat mixing area including portions of at least one of the cover film and the base film that formed at least part of each chamber; and (c) mixing said substances on said substantially flat mixing area.

* * * * *

UNITED STATES PATENT AND TRADEMARK OFFICE

CERTIFICATE OF CORRECTION

PATENT NO. : 7,172,066 B2
APPLICATION NO. : 10/275819
DATED : February 6, 2007
INVENTOR(S) : Peuker et al.

It is certified that error appears in the above-identified patent and that said Letters Patent is hereby corrected as shown below:

Title Page, item 56
References Cited, under Foreign Patent Documents, please delete:

| | | | |
|---|---|---|---|
| "EP | 0916583 | A2 | 5/1998" and insert in place thereof |
| --EP | 0916583 | A2 | 5/1999--. |

Item (57) ABSTRACT
delete "The invention relates to a device for storing and mixing especially pasty materials, preferably dental materials, such as filler materials. The invention comprises at least one compartment (7) that receives the substance, said at least one compartment (7) being formed by sealing (3) a base film (1) and a cover film (2), which can be detached from each other by peeling." and insert in place thereof --A device for storing and mixing especially pasty materials comprises at least one chamber adapted to receive a substance. The chamber can be formed by peelably sealing a base film to a cover film. The device can be used to store and mix dental materials, such as filler materials.--

Column 6,
Line 19, delete "base-film" and insert in place thereof --base film--.

Column 10,
Line 33, delete "substance" and insert in place thereof --substance,--.

Signed and Sealed this

Twenty-seventh Day of May, 2008

JON W. DUDAS
*Director of the United States Patent and Trademark Office*